US006688269B1

(12) United States Patent
Steinmetz

(10) Patent No.: US 6,688,269 B1
(45) Date of Patent: Feb. 10, 2004

(54) ROLLER TAPPET

(75) Inventor: Christoph Steinmetz, Ludwigsburg (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 10/148,623

(22) PCT Filed: Nov. 2, 2000

(86) PCT No.: PCT/EP00/10805

§ 371 (c)(1),
(2), (4) Date: May 31, 2002

(87) PCT Pub. No.: WO01/40632

PCT Pub. Date: Jun. 7, 2001

(30) Foreign Application Priority Data

Dec. 3, 1999 (DE) ..... 199 58 314

(51) Int. Cl.[7] ..... F01L 1/14

(52) U.S. Cl. ..... 123/90.48; 123/90.49; 123/90.5

(58) Field of Search ..... 123/90.48, 90.49, 123/90.5, 90.52, 90.53, 90.55, 90.56, 90.57, 90.59; 74/569

(56) References Cited

U.S. PATENT DOCUMENTS

| | | | | |
|---|---|---|---|---|
| 4,231,267 A | | 11/1980 | Van Slooten | |
| 5,127,374 A | * | 7/1992 | Morel et al. | 123/90.35 |
| 5,178,107 A | * | 1/1993 | Morel et al. | 123/90.35 |
| 5,239,951 A | | 8/1993 | Rao et al. | |
| 5,261,361 A | * | 11/1993 | Speil | 123/90.22 |
| 5,931,133 A | | 8/1999 | Giannone et al. | |
| 6,164,255 A | * | 12/2000 | Maas et al. | 123/90.16 |

FOREIGN PATENT DOCUMENTS

| | | |
|---|---|---|
| DE | 29 41 495 | 5/1980 |
| DE | 41 17 425 | 7/1992 |
| DE | 44 21 535 | 12/1995 |
| DE | 198 52 605 | 5/2000 |
| JP | 7208121 | 8/1995 |

* cited by examiner

*Primary Examiner*—Thomas Denion
*Assistant Examiner*—Jaime Corrigan
(74) *Attorney, Agent, or Firm*—Collard & Roe, P.C.

(57) ABSTRACT

The invention relates to a roller tappet, with at least the shaft made from plastic. The aim of the invention is to achieve a weight-saving mounting of the roller. The aim is achieved, in that the axle carrying the roller may be clipped into the insert, which is of unitary construction with the shaft piece.

5 Claims, 2 Drawing Sheets

ROLLER TAPPET

CROSS REFERENCE TO RELATED APPLICATIONS

Applicant claims priority under 35 U.S.C. §119 of German Application No. 199 58 314.5 filed Dec. 3, 1999. Applicant also claims priority under 35 U.S.C. §120 of PCT/EP00/10805 filed Nov. 2, 2000. The international application under PCT article 21(2) was not published in English.

The invention relates to a roller tappet according to the preamble of claim 1 for internal combustion engines. Such a roller tappet is known from Japanese Patent 7-208121 A.

In the known roller tappet, the roller is mounted in conventional manner.

The invention deals with the problem of providing a weight-saving mounting for the roller in the main tappet body. For roller tappets of the class under consideration, this problem is solved by the characterizing features of claim 1. Advantageous improvements are subject matter of the dependent claims.

The invention will be explained in more detail hereinafter on the basis of a drawing, wherein.

Figure 1:
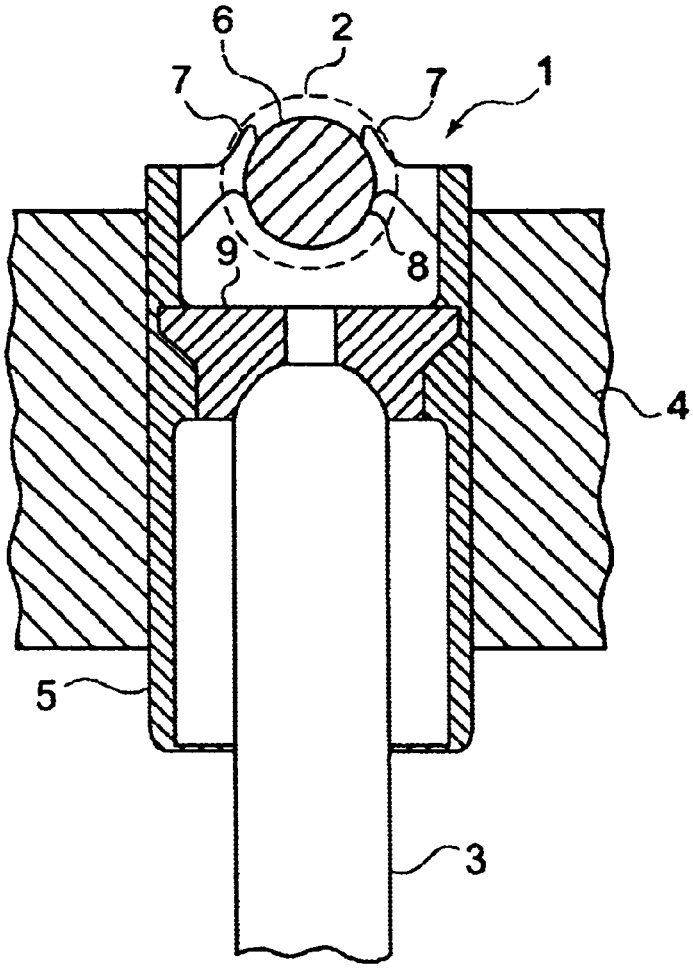
FIG. 1 shows an inventive roller tappet in cross section

A roller tappet 1 is provided with a main tappet body having a shank 5, which guides roller tappet 1 in an engine case 4. The main tappet body is made of fiber-reinforced plastic. In the main tappet body there is mounted a pin 6, which carries a roller 2, indicated by a broken line in the drawing. Onto the main tappet body there are molded, in total, four elastically deformable or compliant stays 7, into which pin 6 is clipped. A metal component 9, which absorbs the force of a tappet rod 3 and transmits it via pin 6 to roller 2, is embedded in the main tappet body by injection molding. Pin 6 is in contact over an angle of about 130° with metal component 9 which, together with the main tappet body and stays 7 molded thereon, functions as a bearing for the pin.

Figure 2:
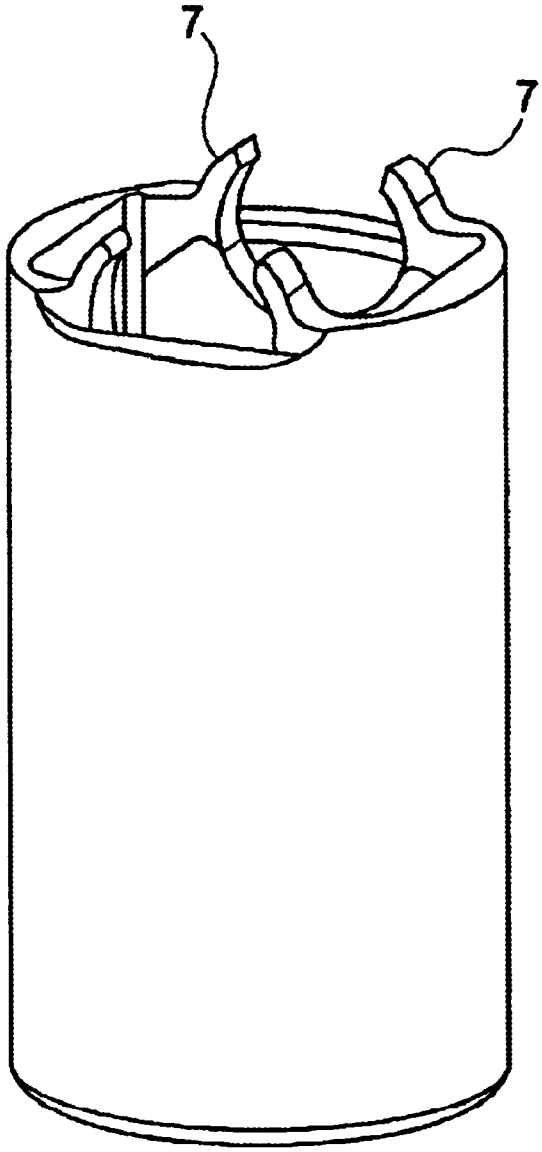
FIG. 2 shows a three-dimensional diagram of the main tappet body.

Metal component 9 has in its lower region a spherical recess to receive tappet rod 3 and in its upper region two bearing stays to support the pin. In FIG. 2, the separating line between the metal component and the plastic region of the main tappet body can be seen under stays 7.

What is claimed is:

1. A roller tappet (1) for internal combustion engines with a main tappet body, a roller (2) and a pin (6) supporting the roller (2), wherein at least the shank part (5) guiding the roller tappet in the engine case (4) is made of plastic, characterized in that the pin (6) supporting the roller (2) is snapped into stays (7), which are integral with shank part (5).

2. A roller tappet according to claim 1, characterized in that at least the shank part (5) is made of fiber-reinforced plastic.

3. A roller tappet according to claim 1, characterized in that the stays (7) together with the main tappet body form two bearings (8) with an angle of contact greater than 200° for the pin (6), which has circular cross section.

4. A roller tappet according to claim 3, characterized in that the embedded metal part (9) is provided in the embedded region with a channel toothing or a spline toothing in order to prevent twisting of the metal part in the main tappet body.

5. A roller tappet according to claim 1, characterized in that the region of the roller tappet absorbing the force of a tappet rod (3) and part of the bearings (8) are formed by a metal part (9), which is embedded during production of the main tappet body by plastic injection molding.

* * * * *